US009426852B2

(12) United States Patent
Zudrell-Koch

(10) Patent No.: US 9,426,852 B2
(45) Date of Patent: Aug. 23, 2016

(54) DUAL MODE ANALOG AND DIGITAL LED DIMMING VIA MAINS VOLTAGE

(71) Applicant: Dialog Semiconductor GmbH, Kirchheim/Teck-Nabern (DE)

(72) Inventor: Stefan Zudrell-Koch, Germering (DE)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 14/626,987

(22) Filed: Feb. 20, 2015

(65) Prior Publication Data

US 2015/0237694 A1 Aug. 20, 2015

(30) Foreign Application Priority Data

Feb. 20, 2014 (EP) ..... 14156029

(51) Int. Cl.
*H05B 33/08* (2006.01)
*H05B 37/02* (2006.01)
*H05B 41/28* (2006.01)
*H05B 41/392* (2006.01)

(52) U.S. Cl.
CPC ..... *H05B 33/0815* (2013.01); *H05B 33/0848* (2013.01); *H05B 37/0209* (2013.01)

(58) Field of Classification Search
CPC ..... H05B 33/0815; H05B 37/0209; H05B 41/28; H05B 41/3927
USPC ..... 315/307
See application file for complete search history.

(56) References Cited

U.S. PATENT DOCUMENTS 9,220,141 B2 * 12/2015 Knoedgen ..... H05B 33/0842
2012/0280629 A1 * 11/2012 Gaknoki ..... H05B 33/0815 315/186
2012/0326616 A1 12/2012 Sumitani et al.
2013/0154504 A1 * 6/2013 Hick ..... H05B 37/0245 315/287
2013/0270998 A1 * 10/2013 Pi ..... H05B 33/0863 315/51
2014/0015423 A1 * 1/2014 Williams ..... H05B 33/0815 315/161
2014/0217887 A1 * 8/2014 Knoedgen ..... H05B 33/0815 315/51

(Continued)

FOREIGN PATENT DOCUMENTS

EP 2477461 7/2012

OTHER PUBLICATIONS

European Search Report 14156029.2-1802, Jul. 15, 2014, Dialog Semiconductor GmbH.

*Primary Examiner* — Dylan White
(74) *Attorney, Agent, or Firm* — Saile Ackerman LLC; Stephen B. Ackerman

(57) ABSTRACT

A controller for a lamp assembly is disclosed. The controller comprises:

a mains sensing unit arranged to detect a mains voltage supplied to the lamp assembly;

a waveform evaluation unit coupled with the mains sensing unit and arranged to generate a light control signal based on the mains voltage waveform;

a demodulation unit coupled with the mains sensing unit and arranged to demodulate a data signal modulated on the mains voltage;

an arbitration unit coupled with the demodulation unit and arranged to evaluate the results of the waveform evaluation unit and the demodulation unit and to decide an operation mode; and a control unit coupled with the arbitration unit and arranged to generate a drive signal to drive a light source of the lamp assembly based on the determined light control signal or the demodulated data signal depending on the decided operation mode.

19 Claims, 10 Drawing Sheets

(56) References Cited

U.S. PATENT DOCUMENTS

2014/0217918 A1* 8/2014 Knoedgen ..... H05B 33/0848
315/224

2014/0300274 A1* 10/2014 Acatrinei ..... H05B 33/0815
315/85

* cited by examiner

DUAL MODE ANALOG AND DIGITAL LED DIMMING VIA MAINS VOLTAGE

TECHNICAL FIELD

The present document relates to controlling of light assemblies via mains voltage. In particular, the present document relates to a controller for controlling the illumination of a lamp assembly. The principles of the invention are applicable to lamp assemblies such as solid state lighting (SSL) devices (LED, OLED or PLED assemblies) as well as any other lamp assembly, e.g. compact fluorescent lamps (CFL).

BACKGROUND

The illumination of a lamp assembly may be controlled using standard phase cut dimmers, thereby signaling dimming information in the form of a conduction angle to the lamp assembly. Phase cut dimmers may operate in different modes such as leading edge dimmers or trailing edge dimmers. There are however some challenges regarding stable dimming and illumination control for lamp assemblies that dissipate only little power. For instance, some phase cut dimmers require a minimum load and may exhibit false firing and flickering, especially at low diming levels. Moreover, different characteristics of different types of dimmers and lamps assemblies are to be taken into consideration. A clear distinction between different dimming modes is sometimes difficult to achieve. Further, different characteristics (e.g. non-linearity, transient periods, etc.) associated with different dimming curves should be taken into account.

The Digital Load-Side Transmission (DLT) lighting control specification defined by IEC 62756 and U.S. Pat. No. 8,217,589 B2 describe the superposition of a small amplitude modulated (AM) baseband signal on the mains voltage by a control device (e.g. a dimmer switch) in order to control the illumination of connected lamp(s). A protocol is specified to control brightness/intensity, color, color temperature and other parameters for lighting sources such as CFL, LED, etc. The effective transmission rate for conveying lamp control data is 200 bit/s at 50 Hz and 240 bit/s at 60 Hz. Other digital data modulation power line communication techniques for controlling the operation of a lamp assembly are also available and within the scope of the present document.

SUMMARY

There is a need for lamp assemblies (e.g. LED retrofit lamps) which are capable to operate under normal phase cut dimming conditions as well as for digital data modulation (e.g. DLT) dimming by automatically adapting to the one or the other dimming technology. Hence, a single controller adapted to operate with different dimming technologies is desired. In a broad aspect the present document describes a system and method to detect, at a lamp assembly, the dimmer technology applied to a mains voltage and switch to the corresponding operating mode of the lamp assembly.

While most of the further explanations refer to the field of LED retrofit lamps and dimming of LEDs, the present disclosure is not limited to SSL devices and can be applied to other lamp assemblies and other forms of controlling characteristics of a lamp as well. For example, the color or light temperature can be controlled in a similar way as dimming the light intensity.

The present document is directed at overcoming the above indicated limitations by detecting different analog and digital dimming signals of a mains voltage while enabling a proper switching to a corresponding operating mode of a lamp assembly controller. In the following, an operating mode used to dim a lamp assembly is also called dim mode. In other words, the invention, described herewith, relates to a system and a method to detect the dimmer technology applied to the mains supply for a lamp assembly and switch to the corresponding operating mode in order to control the illumination of the lamp assembly.

In particular, in a broad aspect, the present document is directed at distinguishing a digital data modulation mode from an analog phase cut dimmer mode and switching to the corresponding mode of operation, hereby enabling, for instance, a universal LED lamp which is DLT compatible and also properly responds to phase cut dimmers of different types.

A controller configured to control a lamp assembly is described. In particular, the controller is configured to detect the dimmer technology applied to the mains supply and to switch the lamp assembly to the corresponded dim or operating mode. For this purpose, the controller comprises a mains sensing unit which is arranged to sense or receive a mains voltage supplied to the lamp assembly; a waveform evaluation unit which is coupled with the mains sensing unit and arranged to generate a light control signal based on the waveform of the mains voltage, e.g. by evaluating the waveform of the mains voltage; and a demodulation unit which is coupled with the mains sensing unit and arranged to demodulate a data signal modulated on the mains voltage. Evaluating the waveform of the mains voltage and demodulating data from the mains waveform may be performed in parallel, e.g. by two separate units operating simultaneously, or may be performed sequentially in a time multiplexed manner. In the following, the term "conduction angle" is used to indicate that a phase cut dimmer has "cut away" a portion of a mains half-cycle, either in the beginning of the half-cycle (by a leading edge phase cut dimmer) or at the end of the half-cycle (by a trailing edge phase cut dimmer). The conduction angle can e.g. be defined as the ratio between the duration of the on-state, where the mains voltage is supplied to the lamp assembly, and the duration of the full mains cycle. For example, a conduction angle of 0.6 (or 60%) means that the mains voltage is available for 60% of the time of the mains period. Other definitions are possible (e.g. based on relative energy content of the phase cut signal) and within the scope of the present document. In embodiments, the waveform evaluation unit may determine the conduction angle of a phase cut applied to the mains voltage and generate a respective light control signal.

An arbitration unit which is coupled with the demodulation unit may be provided. The arbitration unit may decide an operating mode of the controller. The arbitration unit may be further coupled with the waveform evaluation unit and arranged to evaluate the results of the waveform evaluation unit and the demodulation unit in order to decide the operating mode of the controller, e.g. based on whether the waveform evaluation unit has been able to determine a phase cut (e.g. determines a conduction angle <1) and/or whether the demodulation unit has been able to successfully decode digital data from the mains voltage.

The waveform evaluation unit and the demodulation unit may each output a light control signal that is indicative of the relative brightness to be produced by the lamp assembly in case of dimming control. For example, the relative brightness values may be in the range of 0-100% (or scaled to 0-1), or in any other useful range such as 0-255 (which can be encoded in one byte). In a similar manner, other parameters for controlling the lamp assembly may be decoded by the waveform evaluation unit and the demodulation unit from the mains voltage and presented to the arbitration unit. In order to facilitate the operating mode decision of the arbitration unit, the values supplied by the waveform evaluation unit and the demodulation unit to the arbitration unit may be comparable, represented in the same data format, and/or similarly scaled.

In addition or alternatively, the waveform evaluation unit and/or the demodulation unit may output a signal indicating if they have been successful in determining a phase cut or demodulating a data signal from the mains supply. The arbitration unit may decide an operating mode based on at least one of these achievement signals.

The arbitration unit may forward the decided operating mode to a control unit coupled with the arbitration unit and arranged to generate a drive signal to drive a light source of the lamp assembly. The drive signal may be generated based on the operating mode decided by the arbitration unit and the quantitative results of the waveform evaluation unit and the demodulation unit. The drive signal may be supplied to a power converter to drive the light source. Thus, the light source is driven depending on the operating mode, i.e. in accordance with the dimmer technology that was applied to the mains supply. This allows a universal controller and in consequence a universal light assembly that can be used for all kinds of dimmer technology, which automatically detects the appropriate operating mode.

The operating modes can be, but are not limited to, a "Full Mains Mode", a "Leading Edge Mode", a "Trailing Edge Mode" or a "DLT Mode". Example signals according to each dim or operating mode are outlined with respect to the description of FIGS. 5*a*-5*h*.

The controller may further comprise a load control unit (load controller) that is coupled with the mains sensing unit and a loading unit of the lamp assembly. The load control unit may be arranged to control the loading unit based on the mains phase angle, e.g. the present value or state of the mains voltage so as to apply a suitable load to the mains supply. The loading unit, i.e. the loading element, is coupled with the input of the lamp assembly and arranged to apply a configurable electrical load to the mains voltage. The loading unit may be implemented in the controller or in the power converter. The control rules for configuring the loading unit may depend on the decided operating mode (e.g. the dimmer type applied to the mains supply as detected by the arbitration unit). As such, a seamless adaptation of the controller to the load requirements of each type of dimmer is provided. Moreover, providing a configurable load to the mains voltage, as defined, ensures (at least temporally) current flowing through the system so that a 2-wire control unit (dimmer) that is connected in series with the lamp assembly can draw power to drive its own internal units.

In addition, the load control unit may comprise a state machine which controls the configurable load e.g. based on the operating mode. This state machine may be encoded into a processor of the controller, as software, firmware or hardware. Typically, the state machine defines a plurality of states relating to different load parameters, such as different dimmer technologies applied to the mains supply.

The load controller may control the configurable load depending on the decided operation mode. Further the load controller may control the configurable load so that no input current or a predetermined small input current is drawn from the mains voltage during a data period of the mains cycle if a digital data modulation dim mode is decided by the arbitration unit. Thus, data transmission is not disturbed by artifacts caused from drawing power from the mains supply, e.g. by a power converter generating a supply current for the light source. In particular, the control unit may generate the drive signal to control a switched mode power converter that drives the light source. When a data modulation dim mode is decided by the arbitration unit, the control units may generate the drive signal such that substantially no power is transferred by the switched mode power converter during an initial dimmer supply period and/or a data transmission period of the mains cycle. For example, PWM signals to drive the power converter may be switched off during the initial dimmer supply period and/or the data transmission period. In other words, energy is only transferred by the power converter to the light source during a defined operating period of the mains cycle, while the power converter is switched off during other times. For example, one or more of the switching elements of a dual stage SEPIC/Flyback converter may be inactive during the initial dimmer supply period and/or the data transmission period of a mains half wave.

Further, the load control unit may comprise an event detection unit, e.g. in form of a first mains voltage level comparator to detect voltage crossing events, to facilitate synchronization with the incoming mains voltage and identify different portions of a main cycle. The state machine may comprise a plurality of load states and state transitions that are triggered based on the detection of events. A load state may define the configuration of the load applied by the loading unit, i.e. the characteristics of the loading element. Thus, by comparing the mains voltage (or a voltage derived therefrom) with defined thresholds, appropriate load conditions for individual portions of the mains waveform for the applied dimmer technology may be provided.

The load control unit may cause the loading unit to apply different loads to the mains voltage depending on predetermined time periods of the mains voltage cycle. In other words, the load control unit is able to determine events such as timeout events and voltage crossing events alone or in combination, thereby enabling a controlled actuation on the loading unit depending on different types of events (e.g. voltage/time events alone or in combination thereof) as well as depending on different characteristics of types of dimmer technologies.

In embodiments, it is initially assumed that a DLT dimmer is present and a corresponding configuration for the loading unit is set upon start-up of the system, i.e. upon power-on when no dimmer technology has been detected yet. In this case, the state machine may be configured to apply different loads at different times of the mains cycle to the mains voltage as specified in the DLT specification.

More specifically, the arbitration unit may decide the operating mode based on whether a phase cut dimmer or a digital data modulation, e.g. by DLT, was applied to the mains voltage.

The waveform evaluation unit may comprise a second voltage level comparator to compare the mains voltage (or a voltage derived thereof) at predetermined times of the mains voltage cycle with predetermined voltage thresholds to determine the light control signal or a conduction angle based on the comparing results.

Alternatively or in addition, the waveform evaluation unit may comprise an energy measurement unit to determine the root-mean-square (RMS) of a mains voltage half-wave. The waveform evaluation unit can then determine the light control signal or conduction angle from the determined energy measurement, e.g. by using a table mapping energy/RMS values with conduction angles.

The waveform evaluation unit may comprise a phase cut dimmer detection unit arranged to detect whether a phase cut dimmer (e.g. a leading edge or a trailing edge phase cut dimmer) was applied to the mains voltage. This may be achieved by tracking the mains voltage along its expected normal curve and observing significant differences thereof, e.g. lack of mains voltage in the initial part of the mains cycle (in case of an leading edge dimmer), or in the final part of the mains cycle (for a trailing edge dimmer).

The demodulation unit may comprise a digital receiver to determine the data signal that was modulated on the mains voltage in particular by power line communication techniques. Different demodulation techniques may be applied to decode a data signal from the mains voltage, depending on the expected power line communication techniques.

The digital receiver may be arranged to demodulate a baseband signal from the mains voltage. For example, the digital receiver may apply an amplitude demodulation schema to a portion of the mains cycle in order to decode DLT data from the mains voltage.

The arbitration unit may decide a phase cut dim mode when the presence of a phase cut on the mains voltage is detected by the waveform evaluation unit but no data signal can be demodulated by the demodulation unit. That is, a leading edge dimmer is recognized when a phase cut for the initial portion of the mains cycle is determined and, due to the similarity of DLT waveforms, when a second condition is met, namely when the demodulation unit (or digital receiver) fails to decode data from the mains waveform. Further, the arbitration unit may decide a data modulation dim mode, e.g. "DLT mode", when the presence of a leading edge dimmer is detected by the waveform evaluation unit and the demodulation unit successfully decoded a data signal from the mains waveform. Due to the differences in waveforms, a trailing edge dimmer can be distinguished rather easy from a DLT signal. Thus, detection of a trailing edge dimmer by the waveform evaluation unit may be used as a criterion to rule out a DLT dimmer applied to the mains system.

The arbitration unit as defined is therefore enabled to work with DLT dimmers, leading edge phase cut dimmers, trailing edge phase cut dimmers as well as when no dimmer is applied to the mains voltage. Moreover, the process of detection of a dimmer mode may be performed once during startup of the system (e.g. when power-on is detected for the lamp assembly) or continuously, e.g. periodically. In embodiments, detection of dimmer mode is performed every N mains half-cycle, N being a small integer such as 2, 5, or 10.

The load control unit may further control the loading unit, i.e. the loading element, to initially apply, during an early portion of a mains half-wave, a small load to the mains voltage when no dim mode has yet been set. Such default configuration when no dim mode has been set so far provides appropriate loading for leading edge and DLT dimmers and allows operation of all dimmer types. A small applied load during the early portion of the mains half-wave in case of no dimer or a trailing edge dimmer increases the power consumption of the lamp but does not cause any irritation or malfunction of the dimmer. Typically, the arbitration unit is able to detect the correct dimmer type within a few mains cycles, so that a correct loading schema can be applied very fast. Once the arbitration unit decided the dim mode, the appropriate loading schema for the applied dimer technology can be applied by the loading unit. The load control unit may apply a small load during an early portion of a mains half-wave as a fallback option if the arbitration unit cannot reliable decide a dim mode.

The arbitration unit may decide a no dim mode when the waveform evaluation unit determines no phase cut or conduction angle. The load control unit may then control the loading unit, i.e. loading element, to apply no load to the mains voltage when in a no dim mode.

Further disclosed is a lamp assembly, comprising the controller as described above; a loading unit; a switched mode power converter; and a light source. The loading unit and the switched mode power converter may have a common transistor element that can be driven in a linear mode to operate as the configurable load to the mains voltage, and in an on/off mode to control the switched mode power converter. For example, in a two stage power converter such as a SEPIC, a first switching element (e.g. a MOS transistor) may be used to drive the first stage (e.g. by PWM control signals) by turning the switching element alternately on and off. The same switching element may also be used as a loading unit for the mains supply when operated in a linear mode, drawing a predetermined amount of load current.

A method for controlling a lamp assembly comprises detecting a mains voltage supplied to the lamp assembly, evaluating the waveform of the mains voltage and determining a light control signal, applying a demodulation process to the mains voltage to demodulate a digital data signal modulated on the mains voltage, deciding a dim or operating mode, and generating a drive signal to drive a light source of the lamp assembly based on at least one of the decided dim or operating mode, the determined light control signal and the demodulated digital data signal. The method may further include determining a phase cut applied to the mains voltage (by determining the conduction angle), and evaluating the determined phase cut and the demodulated data signal to decide the dim or operating mode for the lamp assembly. In embodiments, evaluating the waveform and demodulating a data signal may be performed simultaneously.

It should be noted that controlling the illumination of a lamp assembly is not to be strictly understood as merely controlling the brightness/intensity of the lamp assembly. The term "controlling the illumination of a lamp assembly" is in fact used throughout the description as encompassing all controlling parameters of the lamp assembly such as, for instance, the brightness, the color or the color temperature of the lamp assembly. In particular, control parameters such as for the brightness, the color or the color temperature may be transmitted to the lamp assembly by means of specific data telegram types, for example as the above mentioned DLT specification describes, and decoded by the controller to control the behavior of the lamp assembly.

It should be noted that the methods and systems including its preferred embodiments as outlined in the present patent application may be used stand-alone or in combination with the other methods and systems disclosed in this document. Furthermore, all aspects of the methods and systems outlined in the present patent application may be arbitrarily combined. In particular, the features of the claims may be combined with one another in an arbitrary manner. Further, if not explicitly indicated otherwise, embodiments of the invention can be freely combined with each other.

In the present document, the term "couple" or "coupled" refers to elements being in electrical communication with each other, whether directly connected e.g., via wires, lines, conductive leads, etc., or in some other manner.

BRIEF DESCRIPTION OF FIGURES

The invention is explained below in an exemplary manner with reference to the accompanying drawings, wherein.

DETAILED DESCRIPTION

In the present document, a light bulb "assembly", e.g. LED Lamp assembly, may include components required to replace a traditional incandescent filament-based light bulb, notably light bulbs for connection to the standard electricity supply. In British English (and in the present document), this electricity supply is referred to as "mains" electricity, whilst in US English, this supply is typically referred to as power line. Other terms include AC power, line power, domestic power and grid power. It is to be understood that these terms are readily interchangeable, and carry the same meaning. Moreover, the particular configuration of the radiated light at a given point in time of the light source is referred to as the illumination state. As indicated above, the term "controlling the illumination of a lamp assembly" is used throughout the description as encompassing controlling parameters of the lamp assembly such as, for instance, the light intensity, the brightness, the color or the color temperature of the lamp assembly.

Typically, in Europe electricity is supplied at 230-240 VAC, at 50 Hz and in North America at 110-120 VAC at 60 Hz. The principles set out in the present document apply to any suitable electricity supply, including the mains/power line mentioned, and a DC power supply, and a rectified AC power supply.

Figure 1:
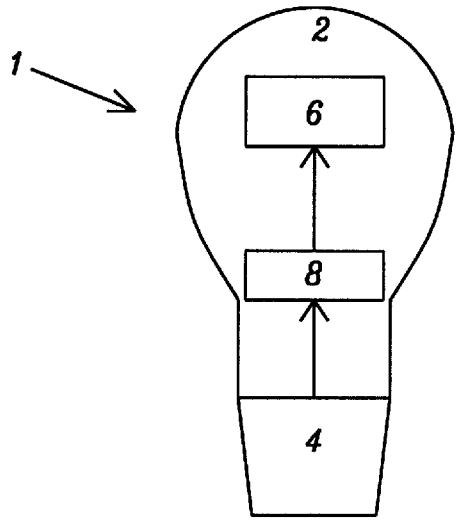
FIG. 1 illustrates a block diagram of an example lamp assembly.

FIG. 1 is a schematic view of a light bulb assembly. The assembly 1 comprises a bulb housing 2 and a base including an electrical/mechanical connection module 4. The base can be of a screw type or of a bayonet type, or of any other suitable connection to a light bulb socket. Typical examples for standardized bases are the E11, E14 and E27 screw types of Europe and the E12, E17 and E26 screw types of North America. Furthermore, a light source 6 (also referred to as an illuminant) is provided within the housing 2. Examples for such light sources 6 are a CFL tube or a solid state light source 6, such as a light emitting diode (LED) or an organic light emitting diode (OLED) (the latter technology is referred to as solid state lighting, SSL). The light source 6 may be provided by a single light emitting device, or by a plurality of LEDs as well as any type other than SSL devices, e.g. compact fluorescent lamps (CFL).

Driver circuit 8 is located within the bulb housing 2, and serves to convert supply electricity received through the electrical connection module 4 into a controlled drive current for the light source 6. In the case of a solid state light source 6, the driver circuit 8 is configured to provide a controlled direct drive current to the light source 6.

The housing 2 provides a suitably robust enclosure for the light source and drive components, and includes optical elements that may be required for providing the desired output light from the assembly. The housing 2 may also provide a heat-sink capability, since management of the temperature of the light source may be important in maximising light output and light source life. Accordingly, the housing is typically designed to enable heat generated by the light source to be conducted away from the light source, and out of the assembly as a whole.

In the following, methods and systems will be described in the context of LED lamps. It should be noted, however, that the methods and systems described herein are equally applicable to controlling the power provided to other types of illumination technologies such as other types of SSL based lamps (e.g. OLEDs) as well as any type other than SSL devices, e.g. compact fluorescent lamps (CFL).

Figure 2:
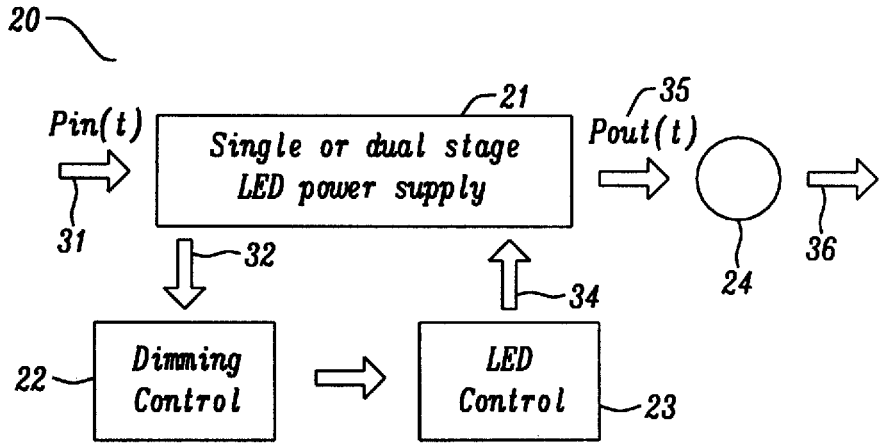
FIG. 2 illustrates an example driver circuit for a lamp assembly.

FIG. 2 illustrates a block diagram of a driver circuit 20 (that is similar or equivalent to the driver circuit 8 of FIG. 1) which may be used to control the illumination of a light source, e.g. LED 24, based on power provided by the mains power supply. The driver circuit 20 receives an input power Pin 31 from the mains supply.

The example driver circuit 20 of FIG. 2 comprises a dimming control unit 22 which senses the input voltage 32 and determines dimming information therefrom. Based on the detected dimming information, a desired dim level is determined and is passed to a LED control unit 23 which controls the single or dual stage LED power supply 21 via a drive signal 34 to provide an output power Pout 35 to the LED 24 (referred to as light source 6 in FIG. 1), which drives the LED 24 to provide light 36 at the desired dim level, based on a dim or operating mode of the driver circuit.

Figure 3A:
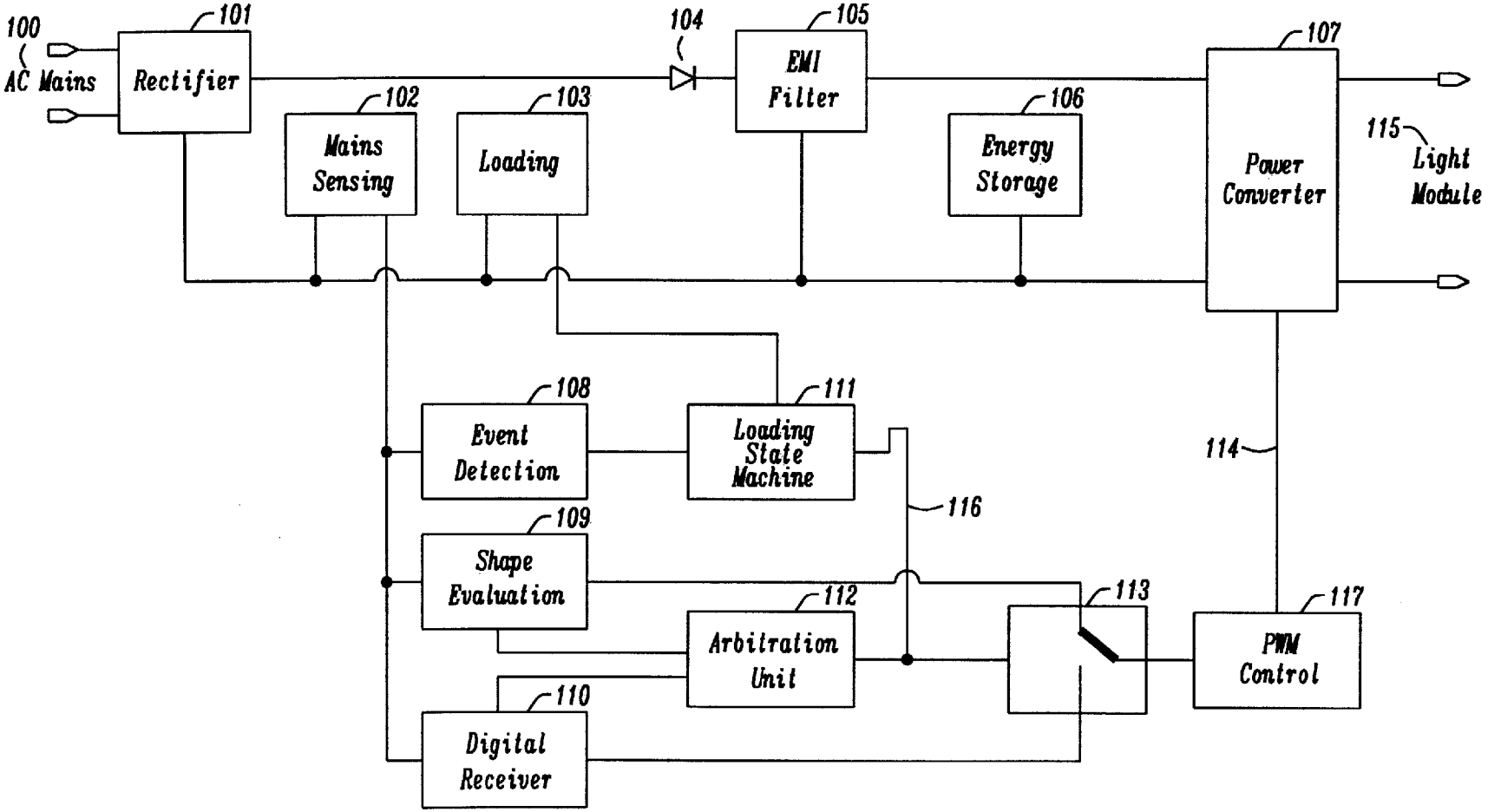
FIG. 3*a* illustrates an example illumination system, e.g. a lamp assembly.

FIG. 3*a* shows a schematic view of an implementation example of a system for controlling a light source 115, e.g. an LED module. The system includes a mains rectifier 101 connected to an AC mains supply 100, a decoupling diode 104, an EMI (electromagnetic interference) filter 105, an energy storage unit 106, a power converter 107 and a controller. The units that are included in the controller will be outlined below. It should be noted that other block arrangements are applicable to the principles of the invention. For instance, the decoupling diode 104 and the EMI filter 105 may be part of the power converter (as shown e.g. in FIG. 4).

The controller includes a mains sensing unit 102 arranged to detect a mains voltage Vin(t) supplied to the lamp assembly (or another quantity that can be derived from the mains supply). The mains sensing unit 102 may be connected before or after (as shown in FIG. 3) the rectifier 101. In some application cases, the mains voltage will be sensed only in the positive voltage domain. Typically, the mains sensing unit 102 comprises a voltage divider combined with A/D conversion. The divider can be partly or in full implemented inside the controller chip. The mains sensing unit 102 may also include analog filter elements before sampling as well as digital filtering of the sampled data.

A loading element 103 is provided and is connected in parallel to the mains supply. This loading element 103 acts as a programmable load and may change the electrical loading for the mains supply as function of the angle of the mains voltage and the detected dim or operating mode. The loading element 103 may comprise a constant current source/sink or a switched resistor. It can be based on MOSFET as well as bipolar junction transistor (BJT). For instance, the loading element comprises a MOSFET (see e.g. MOSFET T1 in FIG. 4, reference number 211) which may be implemented in the power converter 107.

The decoupling diode 104 may be provided between the rectifier 101 and the EMI filter 105 to allow loading of the mains supply without discharging the energy storage unit 106. A decoupling diode is not needed in all embodiments. The EMI Filter 105 is provided in order to eliminate HF noise and keep it away from the mains voltage.

The energy storage unit 106 provides power supply to the power converter 107 during phases where the mains voltage is lower than the voltage across the storage element, which typically is a capacitor. The size of the capacitor may vary depending on the amount of ripple acceptable at the storage element.

Figure 4:
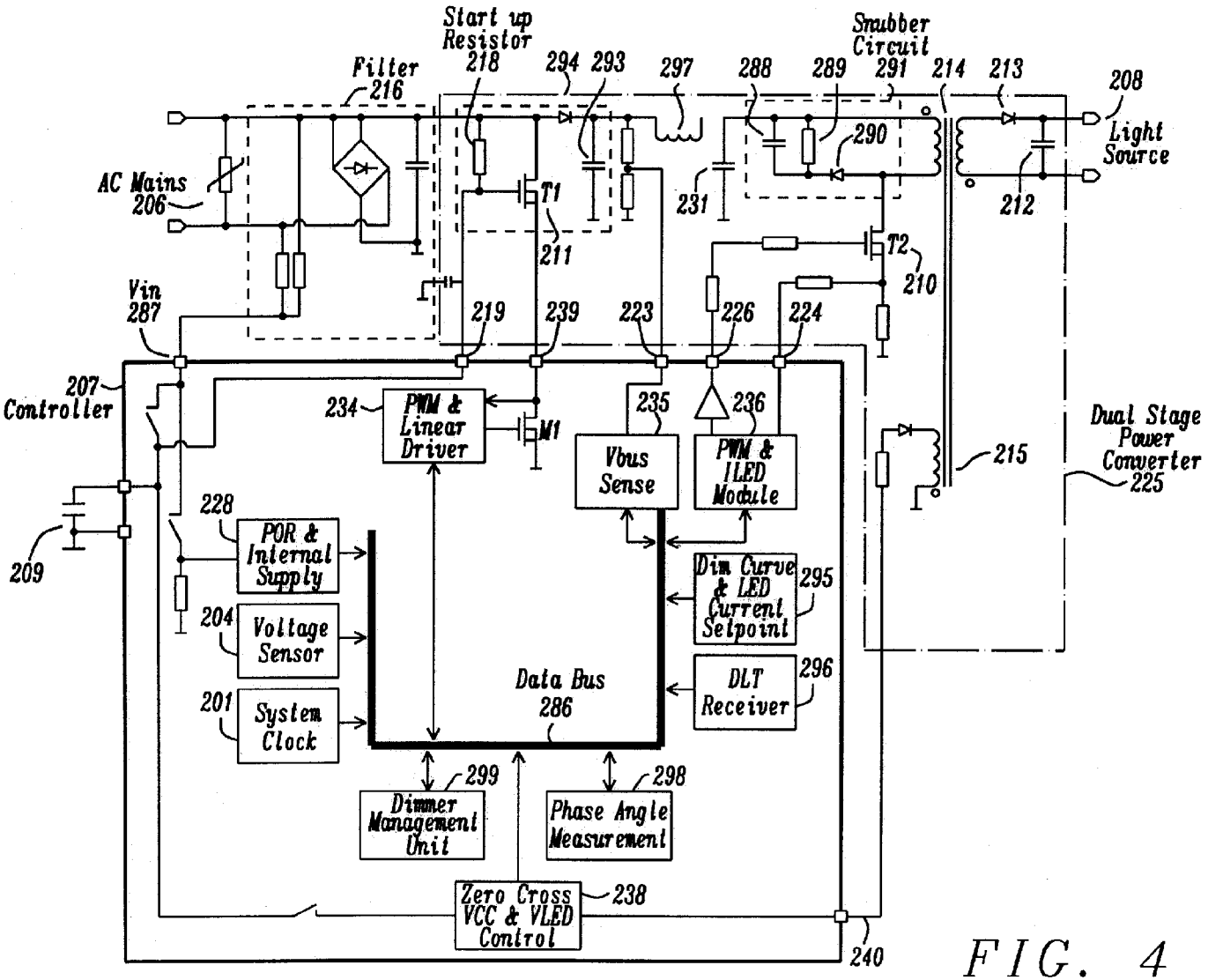
FIG. 4 illustrates an implementation example of the system.

The power converter 107 transforms power received from the energy storage unit 106 (or input voltage 100) into a regulated power for the light module 115. Normally the supplied light current is controlled which means that the power converter 107 transforms input power into a controlled constant current for the light module 115. The power converter 107 may be any switched mode power supply topology or a linear regulator. It may or may not include safety isolation. In many cases, the power converter is implemented as a flyback (see, for instance, the corresponding components in the power converter 225 as shown in FIG. 4).

An event detection unit 108 (e.g. a voltage level compare unit), a shape evaluation unit 109 and a digital receiver 110 are coupled to the mains sensing unit 102 to receive information about the input voltage, e.g. an analogue or digital value which is proportional to the mains voltage.

The event detection unit 108 analyses the mains voltage and controls the loading element 103 to make the parallel loading of the mains supply a function of the instantaneous mains voltage. The event detection unit 108 may work with one or more voltage compare levels to trigger multiple loading conditions. The event detection unit 108 may be implemented as digital or analog system. In many cases, the event detection unit 108 uses a digital data stream generated by the mains sensing unit 102, representing Vin(t), to generate complex and configurable loading schemes.

The waveform shape evaluation unit 109 (which is related to a phase angle measurement unit 298 in FIG. 4) performs a quantitative evaluation of the incoming mains waveform (e.g. the voltage. Vin(t)/time area) in an attempt to determine a light control signal, e.g. by determining a conduction angle of a phase cut dimmer applied to the mains voltage and providing a corresponding light control signal. The waveform shape evaluation unit 109 can be implemented analog or digital. In many cases the shape evaluation unit 109 will operate on digital input values to allow the implementation of complex calculation methods. In a simple case, the shape evaluation unit 109 extracts the amount of time where the voltage is active within a mains period. This is the so called "conduction angle" during which a phase cut dimmer turns the mains voltage on.

Depending on the determined conduction angle, the light control signal is set. For example, if it is determined that 30% of the mains cycle is cut off by a phase cut dimmer, the light control signal may indicate that a light intensity with 70% should be generated by the lamp assembly. The light control signal may also be determined by other means without an explicit determination of the conduction angle, and the relationship between a phase cut and light intensity may be non-linear, e.g. based on the relative amount of energy that is included in a mains cycle.

The shape evaluation unit 109 may comprise one or more mains voltage level comparator(s) to compare the mains voltage, or a voltage derived therefrom, at predetermined times of the mains voltage cycle with predetermined voltage thresholds to determine the conduction angle. In a different example, the module can evaluate the RMS value of the mains voltage. As a special case, the shape evaluation unit 109 detects the case where no phase cut angle is present so the full mains period is active. In this case, it is assumed that no phase cut dimmer has been applied to the mains voltage.

A digital receiver 110 (which is related to the DLT Receiver 296 in FIG. 4) is provided and monitors the incoming mains voltage information for modulated digital data. In case that modulated data is detected, it also receives and decodes the data. The data can be in the form of baseband communication, or it can be modulated via a HF carrier. Various modulation schemes are possible, including the above mentioned DLT technique. Any communication channel which is considered "power line communication" can be used.

A loading state machine 111, which may be a time and event driven state machine, is provided and controls the loading element 103 as a function of the current dim or operating mode, the input voltage and the time within a mains cycle. In many cases, the loading state machine 111 operates on events such as timeout events or voltage crossing events. The change of a dim or operating mode may also be considered an event. In a simple case, the loading state machine 111 can consist of only one state. The loading element 103 may be a function of the mains voltage.

An arbitration unit 112 coupled to the shape evaluation unit 109 and the digital receiver 110 receives the quantitative output of the shape evaluation unit 109 as well as the decoded information of the digital receiver 110 and decides about the operating mode of the system. Alternatively or in addition, the arbitration unit 112 may receive signals from the shape evaluation unit 109 and/or the digital receiver 110 (shown in FIG. 3) which indicate if these units have been successful in detecting a phase cut or demodulating a digital signal, respectively. Such achievement signals may then be processed by the arbitration unit 112 to decide the operating mode. Alternatively, the arbitration unit 112 is only coupled to the digital receiver 110 and receives the decoded information of the digital receiver 110 to decide the operating mode of the system. The operating mode is understood as a particular way of controlling the illumination in the lamp assembly, e.g. the LED module 115, as function of quantities given in the system and received from a control unit (e.g. a dimmer). For example, operating modes are dim modes corresponding to the dimming technology applied to the mains power supply. Example dim modes are phase cut dim modes such as leading edge or trailing edge phase cut dim modes. Other operating modes relate to power lines communication techniques applied to the mains power supply, for example digital load-side transmission (DLT). Since these techniques allow transmission of additional parameters, not related to the light intensity, such as color and color temperature, various other operating modes of the lighting system can be set. When applied to dimming of the emitted light, a data modulation dim mode may be identified when application of a power lines communication technique is detected.

Hence, by means of the arbitration unit 112, the system can determine lighting system operating modes from the input voltage and switch to the corresponding mode of controlling the light source. The operating mode may relate to the type of dimming control applied to the mains power supply, or be indicative of other control parameters for the lighting system such as color, color temperature, etc. Examples of dim modes are phase cut dim modes such as "Leading Edge Mode" and "Trailing Edge Mode", which will be described with regards to FIGS. 5*a*-5*d*. A "Full Mains Mode" may indicate that no phase cut has been applied to the mains voltage. A "DLT Mode" may indicate that a digital load side modulation has been applied. Other operating or dim modes are within the scope of this description.

Information about the decided operating or dim mode may be provided by the arbitration unit 112 to the loading state machine 111 in order to operate on specific states depending on the operating or dim mode. For example, a set of states may be provided in case a leading edge or a trailing edge phase cut dimmer is detected, for configuring the loading element 103 in order to provide appropriate loading for different time periods of the mains supply. Another set of states may be provided for configuring the loading element 103 to provide the mains supply loading required by DLT or other power line communications. Based on the decided operating or dim mode, the loading state machine 111 may select an appropriate state or set of states and operate based on the selected state or state set. For example, the loading state machine may traverse the selected states for the decided operating mode based on a given timing schedule, or voltage crossing events so as to use a different state for the individual phases of the mains cycle.

It should be noted that, although not shown, information from the loading state machine 111 (e.g. the present state or phase of the mains cycle) may also be provided to the arbitration unit 112 to assist in the decision about the dim or operating mode. By knowing where in a mains cycle the present measurements are taken from, the arbitration unit 112 may make improved operating mode decisions.

A dimming channel multiplexer 113 receives a mode control signal from the arbitration unit 112 and respectively selects the output of the shape evaluation unit 109 or the digital receiver 110 for forwarding to a control unit 117. In other words, the dimming channel multiplexer 113 is controlled by the arbitration unit 112 to pass on either dimming information from the shape evaluation unit 109 (for phase cut dimming scenarios) or from the digital receiver 110 (for DLT scenarios). For example, a dimming rate or percentage (0-100%) derived from a detected conduction angle or decoded from received digital data (e.g. via DLT) is selected by the dimming channel multiplexer 113 and forwarded to the control unit 117 for controlling the illumination generated by the light module 115.

The control unit 117 then generates a drive signal 114 based upon the received dimming information. For example, the control unit 117 may be implemented as a PWM controller (similar to the PWM&ILED control unit 236 shown in FIG. 4) that feeds a drive signal 114 to the power converter 107 to control the illumination output. The drive signal 114 may be in a first order proportional to the current/power supplied to the light (LED or SSL) module 115 and hence sets the illumination output of the lighting system.

Received dimming data or data evaluated by the shape evaluation unit 109 may be adapted to match an equivalent SSL current using different methods. One method can be a table lookup using stored memory data to convert a received dimming rate or percentage into a corresponding SSL current. Stored characteristic curves may be used, too. In both cases, the transformation of a received dimming rate or percentage into a corresponding SSL current may be non-linear. Similar techniques may be applied for other light sources such as CFL.

Figure 3B:
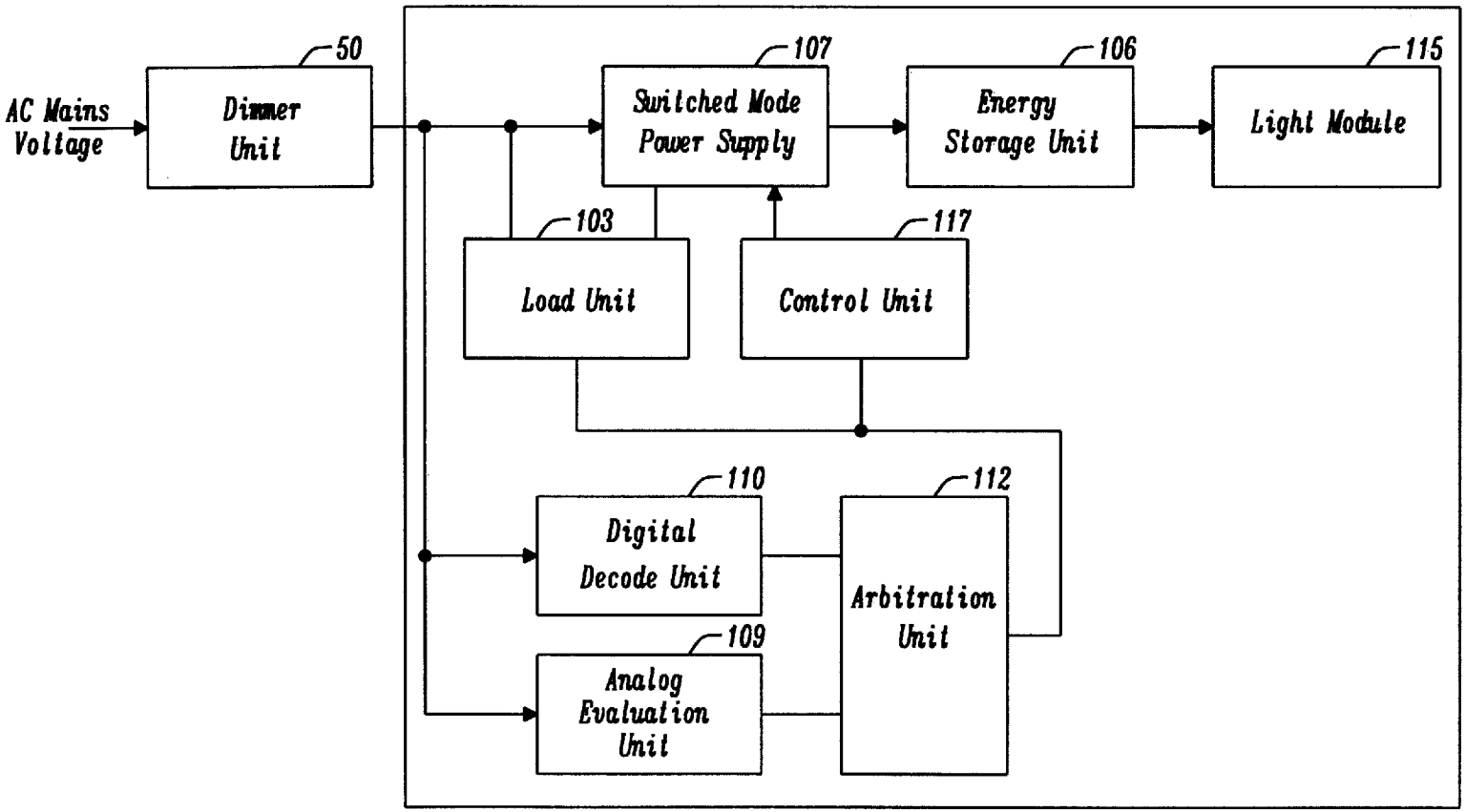
FIG. 3*b* illustrates an example illumination system, e.g. a lamp assembly.

FIG. 3*b* shows schematically another example of a system for controlling a light source, e.g. a LED module. The AC mains voltage is provided to a dimmer unit 50 that applies an analog phase cut to the mains cycle, or applies a digital data modulation on the mains voltage. The mains voltage is then distributed by wiring and supplied to a lamp assembly.

The lamp voltage input as seen by the lamp assembly is provided to a switched mode power supply 107 which is connected to an energy storage unit 106. The power converter 107 transforms power received from the input voltage into a regulated power for a light module 115. In embodiments, the light current supplied to the light module 115 is controlled so that the power converter 107 transforms input power into a regulated current for the light module 115. The power converter 107 may be any switched mode power supply topology. The LED module 115 is connected to the energy storage unit 106. Thus, during periods where the power converter 107 does not provide output power, the LED module 115 is driven by power provided by the energy storage unit 106. The lamp voltage input is further input to a digital decode unit 110 to demodulate a digital signal from the lamp voltage, and to an analog evaluation unit 109 to evaluate the shape of the lamp voltage waveform.

The waveform evaluation unit 109 evaluates the lamp voltage waveform to determine a light control signal, e.g. by determining a conduction angle of a phase cut dimmer applied to the mains voltage. For example, the waveform evaluation unit 109 extracts the amount of time (or percentage) where the lamp voltage is active (differs significantly from zero voltage) within a mains period. This is the so called "conduction angle" during which a phase cut dimmer has turned on the mains voltage.

The digital decode unit 110 monitors the incoming mains voltage information for modulated digital data. In case that modulated data is detected (e.g. according to the above mentioned DLT), it receives and decodes the data.

Arbitration unit 112 decides an operating mode of the lamp assembly based upon, at least, whether the digital decode unit 110 was successful in demodulating a digital signal from the lamp voltage. For example, if a digital data signal can be decoded, a digital data modulation mode is set, otherwise a phase cut dimmer mode is decided, depending on the result of the mains waveform evaluation performed by the analog waveform evaluation unit 109. Arbitration unit 112 may include a multiplexer that receives a mode control signal and respectively selects the output of the evaluation unit 109 or the digital decode unit 110 for forwarding to control unit 117.

Arbitration unit 112 may be coupled to the evaluation unit 109 and the digital decode unit 110 to receive a quantitative output of the evaluation unit 109 as well as the decoded information from the digital decode unit 110, and to decide the operating mode of the system. The operating mode may be used to control the illumination of the lamp assembly, e.g. by the LED module 115, as function of quantities given in the system and received from the dimmer unit 50. For example, operating modes are dim modes corresponding to the dimming technology applied to the mains power supply. Example dim modes are phase cut dim modes such as leading edge or trailing edge phase cut dim modes or a digital load-side transmission (DLT) dim mode.

Depending on the decided operating mode and the detected conduction angle (for a phase cut dimmer) or the decoded digital data (for the digital data modulation mode), control unit 117 generates one or more drive signals for the power converter 107, e.g. PWM signals for one or more transistors that switch the power converter 107. Thus, control unit 117 generates a drive signal based upon the received dimming information. For example, the control unit 117 may be implemented as a PWM controller that supplies a drive signal to the power converter 107 to control the illumination output. The drive signal may be in a first order about proportional to the current/power supplied to the light (LED or SSL) module 115 and hence sets the illumination output of the lighting system.

A load unit 103 provides a configurable load to the lamp voltage, depending on the decided operating mode and the phase angle of the mains cycle as will be explained in detail below. A state machine may be provided to control the applied load. The state machine may operate on events such as timeout events or voltage crossing events. The change of a dim or operating mode may also be considered an event for the state machine.

FIG. 4 illustrates an example circuit diagram of a system comprising an AC mains supply 206, a rectifier in combination with EMI (electromagnetic interference) filter components 216, a dual stage power converter 225, and a controller 207 configured to control operation of a light source 208. The modules included in the controller 207 are interconnected by means of a data bus 286. As indicated above with respect to FIG. 3, different block arrangements are applicable to the principles of the invention.

The controller 207 receives a signal measured across a voltage divider through an input pin Vin 287, whereas parts of the voltage divider can be inside the controller 207 itself. The Vin signal is digitized in a voltage sensing unit 204 using ADC technology (for example a SAR—successive approximation register—or equivalent ADC). Linear filtering may be applied to the sampled data (typically a low pass filter). The sampled data is then evaluated in parallel to decode control (dimming) information for the lamp assembly, using different evaluation criteria. The parallel evaluation can also be performed in a time-multiplexed way by a single unit e.g. if a microcontroller is used. In a preferred embodiment, the parallel evaluation is implemented as fixed logic with data in memory for configuring the evaluation algorithm(s). In the embodiment of FIG. 4, a phase angle measurement unit 298 and a DLT receiver 296 are provided for evaluating sampled (and possibly filtered) Vin data.

A first evaluation criterion relates to the calculation of a measure for the voltage/time area of the incoming signal. In an example this can be a simple duration of the conduction angle using a fixed comparator threshold. In another example it can be a RMS (root mean square) measurement of the input waveform power.

A second evaluation criterion relates to the reception of data which is modulated on the incoming mains voltage. In an example this is baseband data according to the above mentioned DLT specification IEC62756 which is incorporated by reference in its entirety.

The output of both evaluation criteria is used by an arbitration unit, e.g. the arbitration unit 112 as shown in FIG. 3, to generate a mode control signal for the operating mode indicating how an internal dimming control signal is to be generated. This will be outlined in more detail with reference to the FIGS. 5*a*-5*d*. In response to determination of a dim or operating mode by the arbitration unit 112 (not explicitly shown in FIG. 4), the controller 207 changes its operating mode and thereby adapts to the requirements and characteristics of the detected dimmer (e.g. phase cut or DLT).

For example, if the mains input signal is turned on across the full mains period, the output of the arbitration unit indicates a no dim mode and the drive signal for the power converter is set to fix the light output level to 100%. If the presence of a dimmer is detected (i.e. a conduction angle is determined), but no DLT data can be decoded, the output of the arbitration unit is set to a phase cut dim mode, and the light output level is made a function of the mains voltage, in particular depending on the conduction angle. If the presence of a dimmer (in particular a leading edge phase cut dimmer) is detected and DLT data is received, the arbitration unit selects a DLT dim mode, and the light output level is set according to the received DLT dim level data.

The output of the evaluation criteria is used by the above described arbitration unit (not explicitly shown in FIG. 4) to generate a mode control signal for the dim mode that the controller is operating in. A dimmer management unit 299 generates one or more power converter drive signals based upon the dim mode, and a selected one of the conduction angle determined by the phase angle measurement 298 and dim data received by the DLT receiver 296, depending upon in which dim mode the controller operates. The dim mode is further used to control a configurable load of the mains supply in accordance to the required specifications for phase cut dimmers and digital load side data transmission. In embodiments, the arbitration unit may be implemented in the dimmer management unit 299 or a processor of the controller.

The power converter 225 converts power derived from an input voltage waveform of a mains power supply, e.g. the AC mains 206, to a drive signal for the light module 208. The operation of power converter 225 is controlled by the controller 207. In that respect, the controller 207 has a plurality of output pins, e.g. 219, 239, and 226 in FIG. 4, for providing drive signals to power converter switches, e.g. MOSFETs 210 and 211. The drive signals may be pulse width modulated (PWM) driver signals generated by respective control modules, e.g. PWM & linear drive module 234 and PWM & ILED control module 236. Further, the controller 207 may use pin 219 as input during startup for sensing using a startup resistor 218. In this embodiment, a dual stage SEPIC/Flyback converter is provided, wherein the first converter (a SEPIC converter) comprises the components 211, 218, 293 and 294, and wherein the second converter (a flyback converter) comprises the components 212, 213, 214, 215. In the illustrated example, the second converter stage provides for SELV (Separated or safety extra-low voltage) requirements. Furthermore, the output of the first converter stage (Vbus) is sensed via a sensing pin 223 and a Vbus sensing module 235, thereby allowing for a regulation of the first converter stage. In a similar manner, the output of the second converter stage can be sensed using input pin 224 and used by the PWM & ILED control module 236 to generate an appropriate PWM signal for driving transistor T2 210 so that the desired LED current ILED is provided to the light module 208. An inductance 297 is provided between the first and second power converter stages.

In the FIG. 4 embodiment, transistor T1 211 has a dual usage: transistor T1 211 is used as a switch for the first power converter stage by the PWM & linear drive module 234. In addition, transistor T1 211 is operated in a linear mode and driven as a controllable load for the mains supply (i.e. similar to loading 103 in FIG. 3). In the last mode, transistor M1 operates as a current control element determining the current that is sinked by the controllable load. When operated as an on/off switch, transistor M1 determines the gate source voltage of transistor T1 211 and thereby switching T1 on and off. Typically, T1 is operated as a controllable load for the mains supply during periods of the mains cycle where no power is transmitted by the power converter, e.g. when the light module is driven from an energy storage element. During these periods, it is possible to "switch off" the switched power converter (i.e. interrupting PWM drive signals) and use the transistor T1 for a different purpose, namely as a controlled current sink so that a controlled load condition is provided for a dimmer applied to the mains supply.

In general, the power converter 225 may be a single stage power supply or a multi-stage power supply. The use of a multi-stage power converter may be beneficial to stabilize a (rectified) voltage received from the mains supply in a first stage, thereby providing a stable intermediate voltage Vbus, e.g. at a large capacitor 231 between the first stage and the subsequent stage(s). The intermediate voltage may be in the range of 100-200V. The intermediate voltage Vbus is controlled by a Vbus control module (not shown) and the PWM & linear drive module 234 which generates a drive voltage for the internal transistor M1. Subsequently, the conversion to the supply voltage of the light module 208 may be implemented by converting the stable intermediate voltage using a second (and possibly further) power converter stages.

Furthermore, a snubber circuit 291 comprising the components 288, 289 and 290 may be provided between the first and second power converter stages to suppress "snub" phenomenon such as voltage transients which could be a source of electromagnetic interference (EMI) in other circuits.

It should be noted further that each lamp assembly can include several parallel converters and light modules. The illumination parameters (illumination state, brightness, color, color temperature, etc) can therefore comprise a vector of sub parameters valid for each of the parallel power supply and LED modules. All parameters to configure the system may be stored in an OTP (one-time programmable) memory (not shown).

The controller 207 controls the light module 208 using the power converter 225 according to a plurality of parameters, such as, for instance, the illumination state, the brightness, the color or the color temperature, subject to a determined dim or operating mode of a plurality of dim or operating modes. The control of the above mentioned parameters may be performed in a system state machine, e.g. the shown dimmer management unit 299. The controller further comprises a system clock 201 which generates a clock signal for operation of the controller units. Furthermore, a power on reset (POR) & internal supply unit 228 may be incorporated to provide for internal power supply and setting the logic into a defined state upon, for instance, a power-on event. The POR & internal supply unit 228 may include means to sense the input voltage Vin supplied by input pin Vin 287. In addition, a DIM Curve & LED current setpoint unit 295 to translate the received dim information to drive parameters for the light module, such as LED current values, may be provided.

Moreover, the controller 207 is connected to an energy storage element 209 to power the controller 207 during times where no power is supplied by the mains power supply 206. During operation of the power converter 225, the internal operating voltage Vcc for the controller 207 is provided by coil 215 of the flyback converter which is connected (via a diode and a resistor) to input pin 240 and a module Zero Cross Vcc & VLed Control 238. During operation of the power converter 225, the internal operating voltage Vcc is connected (via a switch) to the energy storage element 209. During startup times when the power converter 225 is not yet operating, the operating voltage is generated from the mains input voltage 206 via resistors in the rectifier in combination with EMI filter components 216 and supplied via input pin Vin 287. Since module Zero Cross Vcc & VLed Control 238 receives a feedback from the flyback converter via input pin 240, it can further be used to control the converter output voltage VLED and to determine the zero crossing in the flyback converter, which information may be used to control the switching times of transistor T2 210.

Typical waveform signals according to example dim or operating modes and the corresponding value for a loading element for a half-cycle mains waveform are outlined below with respect to the description of FIGS. 5*a*-5*d*.

Figure 5A:
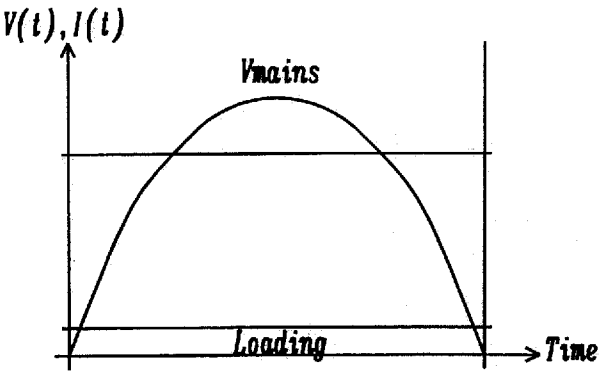
FIGS. 5*a*-5*h* show example signals according to dim or operating modes.

FIG. 5*a* shows an example mains waveform signal when no dimmer is applied. The mains voltage is present for the full cycle (shown is only a half-cycle waveform). No phase cut and no conduction angle can be detected in the waveform by the shape evaluation unit 109 of FIG. 3 or the phase angle measurement unit 298 of FIG. 4. Also no modulated data can be decoded from the waveform by the DLT receiver 110 in FIG. 3*b*, 296 in FIG. 4. The arbitration unit therefore decides a no dim or "Full Mains Mode". The controller generates drive signals for the power converter to set the illumination of the lamp assembly to 100%. No loading for the mains supply is required for this case. The course of the current drawn by the lamp assembly when no dimmer is present is shown in FIG. 5*h*. As can be seen, voltage and current are in phase when no dimmer is present.

Figure 5B:
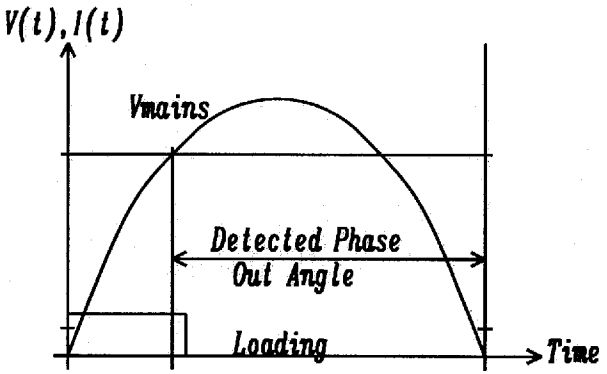
Figure 5C:
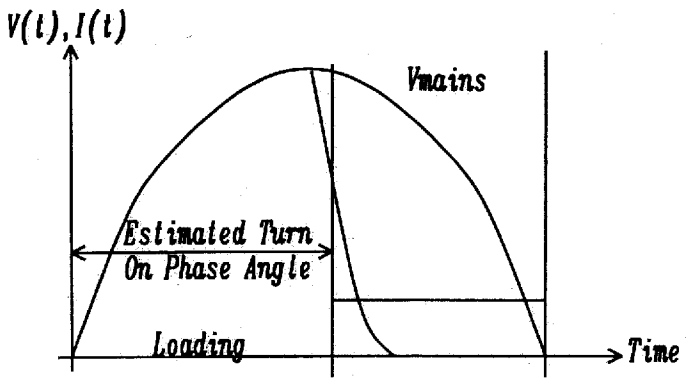
Figure 5D:
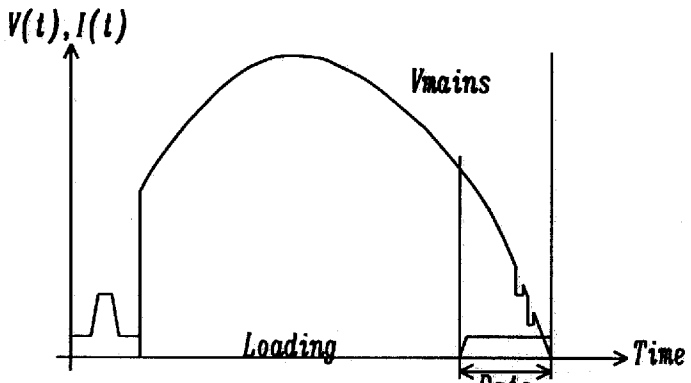

FIG. 5*b* shows an example mains waveform signal when a leading edge phase cut dimmer is applied to the mains power supply of a lamp assembly. An initial part of the half-cycle waveform is cut away by the dimmer and the mains voltage is very small (substantially zero) during this period. At a given conduction angle, the leading edge phase cut dimmer passes the mains voltage through with a steep increase of the voltage to its regular curve. The mains voltage finishes the half-cycle with its regular course and a similar behavior appears for the next half-cycle.

The shape evaluation unit 109 of FIG. 3 or the phase angle measurement unit 298 of FIG. 4 measure when the voltage rises to its regular curve by applying voltage thresholds at regular intervals, e.g. by using a programmable voltage comparator. Based upon the detected time when the voltage rises, a conduction angle between 0 and 180 degrees for the half-cycle can, be determined. Alternatively or in addition, a power RMS measurement for the half-cycle power can be made and the conduction angle determined based upon the measured RMS value (e.g. by comparing the measured RMS value with a table where RMS values for different conduction angles are stored). No modulated data can be decoded in this case from the waveform, e.g. in the final portion of the waveform, by the DLT receiver 110, 296. The arbitration unit therefore decides a (leading edge) phase cut dim mode or "Leading Edge Mode". The controller generates respective drive signals for the power converter to set the illumination of the lamp assembly according to the determined conduction angle. A loading for the initial part of the mains half-cycle is required to prevent malfunctioning of the dimmer and flickering of the light.

Figure 5E:
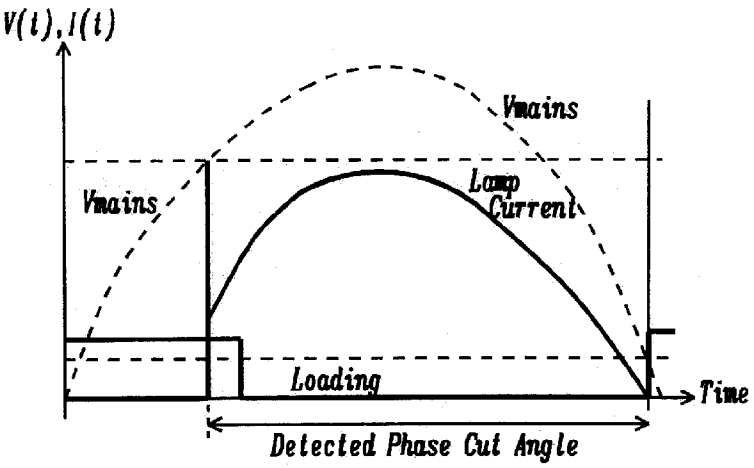

The course of the current drawn by the lamp assembly when a leading edge dimmer is present is shown in FIG. 5*e*. During the initial phase cut period, no lamp current is drawn, i.e. the power converter does not draw/transfer power from the mains voltage. However, in order to allow the dimmer to operate, a defined current must be drawn by the lamp assembly, e.g. by activating a loading element that puts a defined load on the mains supply.

In a similar manner, FIG. 5*c* shows an example mains waveform signal when a trailing edge phase cut dimmer is applied to the mains power supply. A final part of the half-cycle waveform is cut away by the dimmer, and the mains voltage falls from its regular curve rapidly to a very small (substantially zero) value during this period. At a given conduction angle, the trailing edge phase cut dimmer cuts the mains voltage. The mains voltage then continues the next half-cycle with its regular course and a similar behavior appears for the next half-cycle.

Figure 5F:
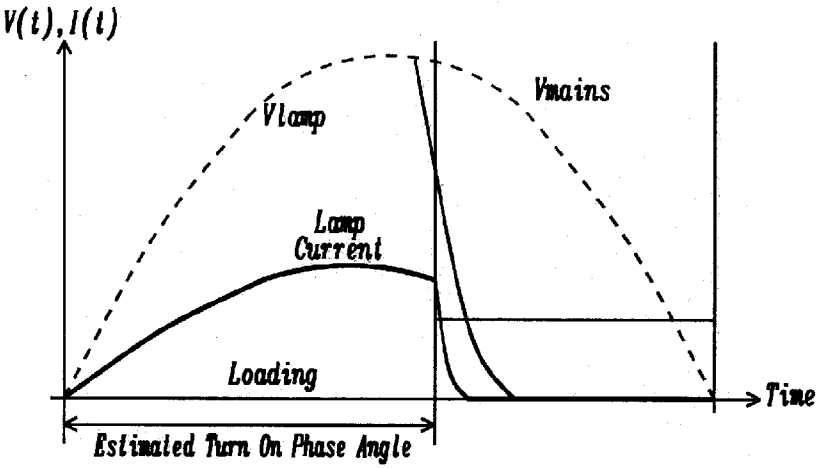

The course of the current drawn by the lamp assembly when a trailing edge dimmer is present is shown in FIG. 5*f*. During the final phase cut period, no lamp current is drawn, i.e. the power converter does not draw/transfer power from the mains voltage. However, in order to allow the dimmer to operate, a defined current must be drawn by the lamp assembly, e.g. by activating a loading element that puts a defined load on the mains supply.

The shape evaluation unit 109 of FIG. 3 or the phase angle measurement unit 298 of FIG. 4 measure when the voltage falls significantly from its regular curve by applying voltage thresholds at regular intervals, e.g. by using a programmable voltage comparator. Based upon the detected time when the voltage falls, a conduction angle between 0 and 180 degrees for the half-cycle can be determined. Alternatively or in addition, a RMS measurement of the half-cycle power can be made and the conduction angle determined based upon the measured RMS value. In case of applying RMS measurement, additional voltage measurements at given points in time of the half-cycle can be made to distinguish leading edge and trailing edge dimmers. No modulated data can be decoded in this case from the waveform, e.g. in the final portion of the waveform, by the DLT receiver 110, 296. The arbitration unit therefore decides a (trailing edge) phase cut dim mode or "Trailing Edge Mode". The controller generates respective drive signals for the power converter to set the illumination of the lamp assembly according to the determined conduction angle. A loading for the final part of the mains half-cycle is required to prevent malfunctioning of the dimmer and flickering of the light.

FIG. 5*d* shows an example mains waveform signal when a digital load side data transmission (DLT) control device (dimmer) according to IEC 62756 is applied to the mains power supply. A fixed initial part of the half-cycle waveform (supply period) is cut away by the control device and used to supply power to the control device itself. A specific load profile shall be applied by the lamp assembly during the supply period. The supply period is defined from the mains voltage zero crossing to the time when the mains voltage exceeds a defined voltage threshold Vsw (e.g. 120 V for 230 V mains system). From that given point in time, the mains voltage follows its regular sine curve to supply power to the load (i.e. the lamp assembly). Starting from a second point in time of the mains (half) period when the mains voltage falls below the voltage threshold Vsw, a small load is to be applied by the lamp assembly to the mains supply. Shortly thereafter, data is modulated by the mains control device within a data window onto the mains curve (data period). The individual phases of the DLT waveform can be identified e.g. by means of a mains voltage level comparator.

Figure 5G:
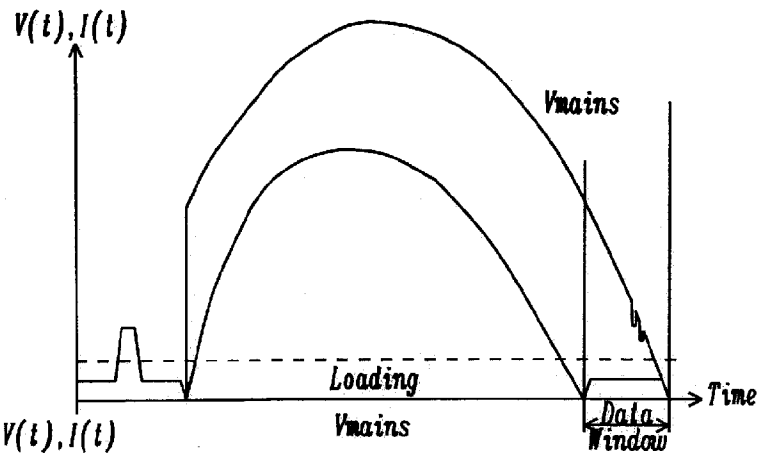
Figure 5H:
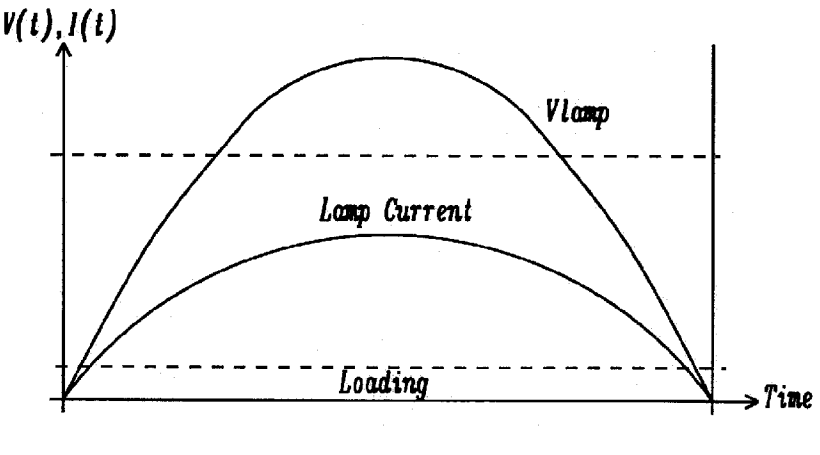

The course of the current drawn by the lamp assembly when a DLT dimmer is present is shown in FIG. 5*g*. During an initial dimmer supply period and during a final data transmission period, no lamp current is drawn, i.e. the power converter does not draw/transfer power from the mains voltage. However, in order to allow the dimmer to operate, a defined current must be drawn by the lamp assembly during the dimmer supply period, e.g. by activating a loading element that puts a defined load on the mains supply. During the data transmission period, the loading element is also activated in order to provide stable and defined conditions for data transmission.

The shape evaluation unit 109 of FIG. 3 or the phase angle measurement unit 298 of FIG. 4 will measure a conduction angle from the DLT waveform, e.g. by applying voltage thresholds at regular intervals, e.g. by using a programmable voltage comparator. Given the similarity of the DLT waveform with the waveform of a leading edge dimmer, a conduction angle can be determined for a DLT waveform. Since the duration of the DLT supply period is fixed in the IEC 62756 specification, the conduction angle determined in this case is known. If such known conduction angle corresponding to a DLT waveform is supplied to the arbitration unit, the arbitration unit can flag the conduction angle as not reliable information. In addition, if the DLT receiver can decode modulated data from the data window of the mains waveform, the arbitration unit can reliably decide a digital data modulated dim mode or "DLT Mode" for the evaluated mains waveform. The controller then generates drive signals for the power converter to set the illumination of the lamp assembly according to the received DLT dim information. A loading of the mains half-cycle according to the DLT specification is set to meet the requirements.

If the presence of a phase cut dimmer is detected but no DLT data can be decoded, the output of the arbitration unit is set to make the illumination of the lamp assembly a function of the mains voltage (FIGS. 5*b*-5*c*). If the presence of a dimmer is detected and DLT data is received, the illumination of the lamp assembly is set according to the received DLT data (FIG. 5*d*).

As described above, the load controller controls the loading element, e.g. the loading element 103 as shown in FIG. 3, to apply, during an initial portion of a mains half-wave, a small load to the mains voltage if a leading edge phase cut dim mode or a digital load-side transmission (DLT) mode has been set by the arbitration unit (see FIGS. 5*b* and 5*d*).

Furthermore, the leading edge or the DLT dimming mode may be configured as default when the controller starts evaluating the mains waveform or when no discrimination is possible between a leading edge dimming mode and a DLT dimming mode. In this default mode, loading of the mains supply in an initial portion of the half-cycle waveform of the mains voltage may be applied to comply with the DLT requirements.

Figure 6A:
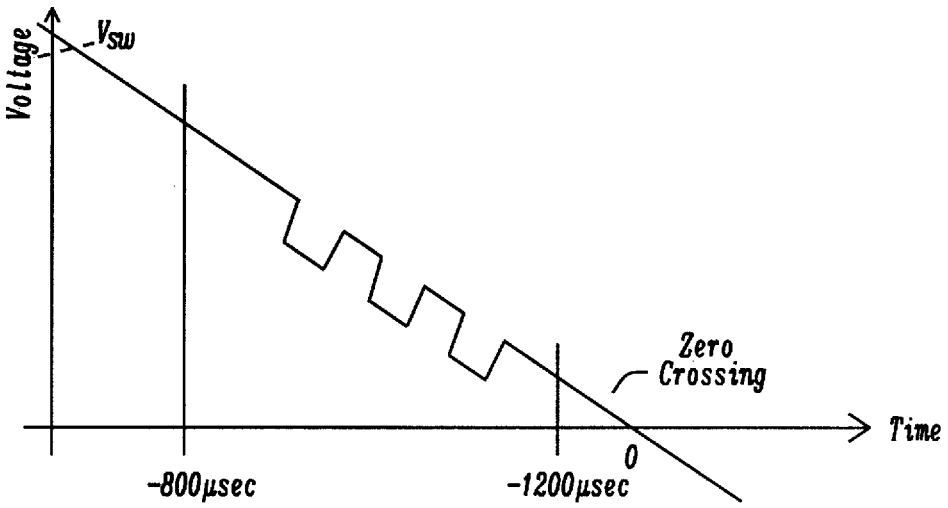
FIG. 6*a* illustrates the data period of a DLT signal.

FIG. 6*a* illustrates an example of the modulation during the data period of a DLT signal. The mains waveform is amplitude modulated during the data period. Data is transmitted between 800 μs and 1200 μs before zero-crossing of the mains voltage cycle. The DLT signal has a fixed packet size of 6 bits during the defined data window, the first bit being always a "1", the last bit being always a "0". The remaining four bits between the first and the last bit encode information using Manchester coding representing two binary digits. For a 230V mains system, the amplitude of the modulation is approximately 15 V with a bit width of 42.5 to 57.5 μs. Further details are set out in the above mentioned DLT specification which is incorporated by reference.

Figure 6B:
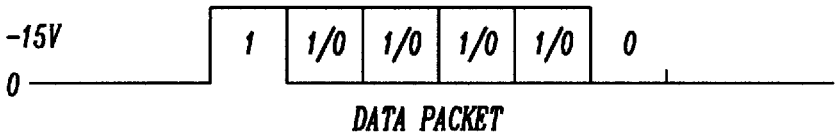
FIG. 6*b* illustrates a DLT data packet.

FIG. 6*b* illustrates a DLT data packet. 8 DLT data packets form a DLT telegram. DLT telegrams are repeated continuously. The specification allows for different telegram types, e.g. brightness telegram, color telegram, color temperature telegram, group assignment telegram, etc. Depending on the telegram type, a certain number of bytes are transmitted to control the lamp. A linear range 1-255 is available for brightness control. Adjustment of the linear value (1-255 corresponding to 0-100% brightness) to operating parameters for the lamp (e.g. LED current) can be made by a characteristic curve that is stored in the lamp controller. 24 bits can be used to transmit (x,y) for color control and 8 bits are available to transmit a color temperature.

Figure 7:
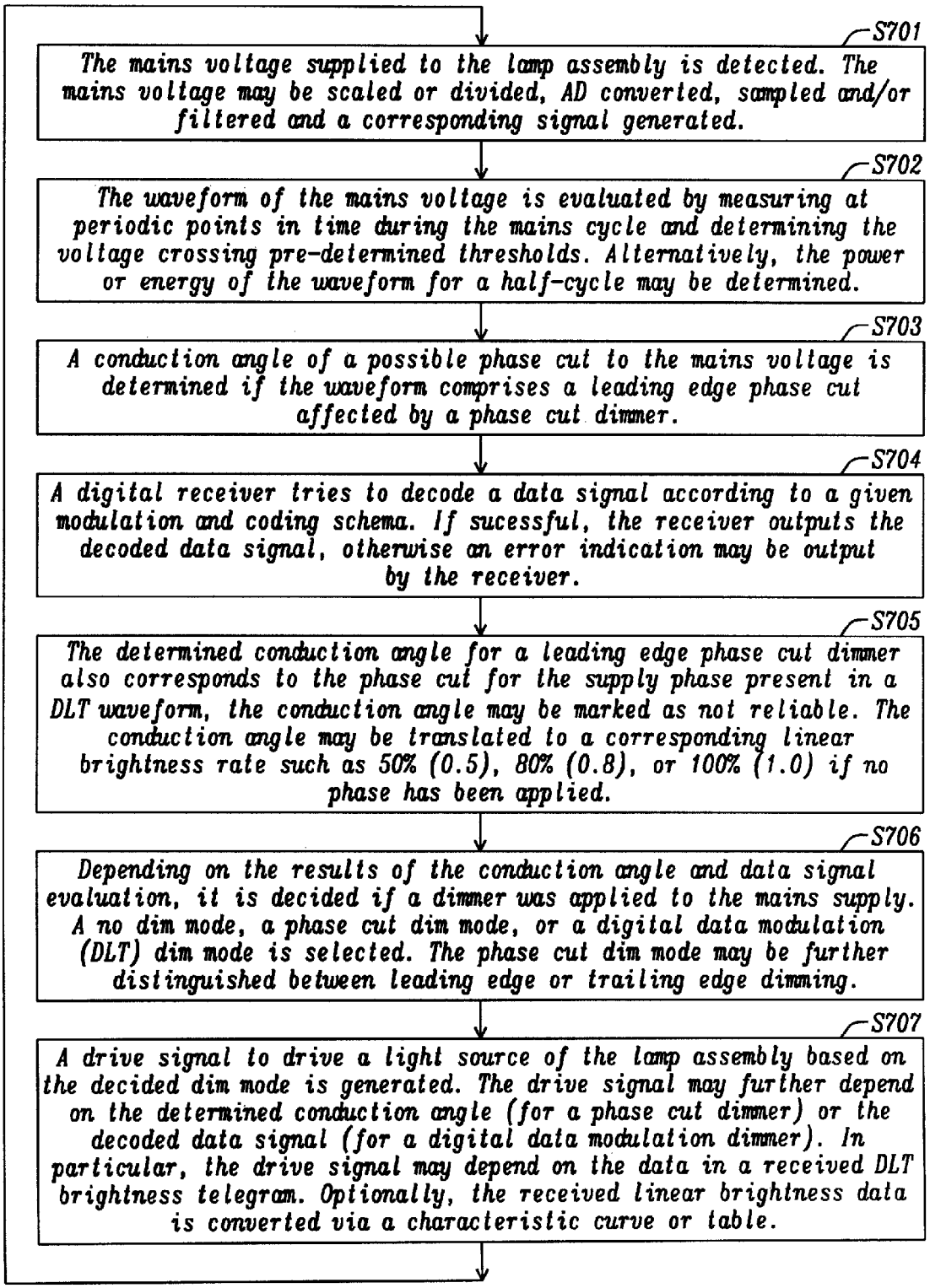
FIG. 7 shows an example flow diagram of a method for controlling the illumination of a lamp assembly.

FIG. 7 shows a flow diagram of a method for controlling a lamp assembly according to the present disclosure.

In step S701, the mains voltage supplied to the lamp assembly is detected from the mains supply. The mains voltage may be scaled or divided, AD converted, sampled and/or filtered and a corresponding signal generated which is derived from the mains voltage. In the following, this derived signal may be used for the further processing.

In step S702 the waveform of the mains voltage is evaluated. The waveform evaluation may be by measuring the mains voltage (or the voltage of the derived signal) at given, possible periodic points in time during the mains cycle and determining the voltage crossing pre-determined thresholds. Alternatively, the power or energy of the waveform for a half-cycle may be determined.

In step S703, a conduction angle of a possible phase cut to the mains voltage is determined in accordance to the evaluated waveform of the mains voltage, if the waveform comprises a leading edge or trialing edge phase cut affected by a phase cut dimmer.

In step S704 a data signal modulated on the mains voltage is demodulated, if possible. In other words, a digital receiver tries to decode a data signal according to a given modulation and coding schema. If successful, the receiver outputs the decoded data signal, otherwise an error indication may be output by the receiver indicating that no data could be decoded. For example for the case of DLT, brightness information from a brightness telegram may be extracted. The brightness information (e.g. 1-255) may be converted to a common dimming data format with the dimming data extracted from the shape of the waveform, e.g. converted to a linear brightness rate from 0% (0.0) to 100% (1.0). Please note that steps S703 and S704 can be performed sequentially or in parallel.

In step S705 the determined conduction angle and the demodulated data signal are evaluated. For example, if the determined conduction angle for a leading edge phase cut dimmer also corresponds to the phase cut for the supply phase present in a DLT waveform, the conduction angle may be marked as not reliable. The conduction angle may be translated to a corresponding linear brightness rate such as 50% (0.5), 80% (0.8), or 100% (1.0) if no phase cut has been applied. The demodulated data signal may be tested to confirm to expected values to comply with the DLT specification and/or to comply with the present state of the light assembly.

In step S706 a dim mode is decided in accordance to the evaluation of the determined conduction angle and the demodulated data signal. Depending on the results of the conduction angle and data signal evaluation, it is decided if a dimmer was applied to the mains supply, and in the positive, which dimmer type was applied. In consequence, a no dim mode, a phase cut dim mode, or a digital data modulation (DLT) dim mode is selected. The phase cut dim mode may be further distinguished between leading edge or trailing edge dimming.

In step S707 a drive signal to drive a light source of the lamp assembly based on the decided dim mode is generated. The drive signal may further depend on the determined conduction angle (for a phase cut dimmer) or the decoded data signal (for a digital data modulation dimmer). In particular, the drive signal may depend on the data in a received DLT brightness telegram. Optionally, the received linear brightness data is converted via a characteristic curve or table lookup to corresponding SSL device drive currents and one or more respective drive signals are output to a power converter. In addition, a loading state machine may be selected based on the selected dim mode. A programmable load may be configured according to the selected loading state machine and an appropriate load applied to the mains supply, possibly in a time varying manner as instructed by the respective state sequence for the selected dimmer technology.

Figure 8:
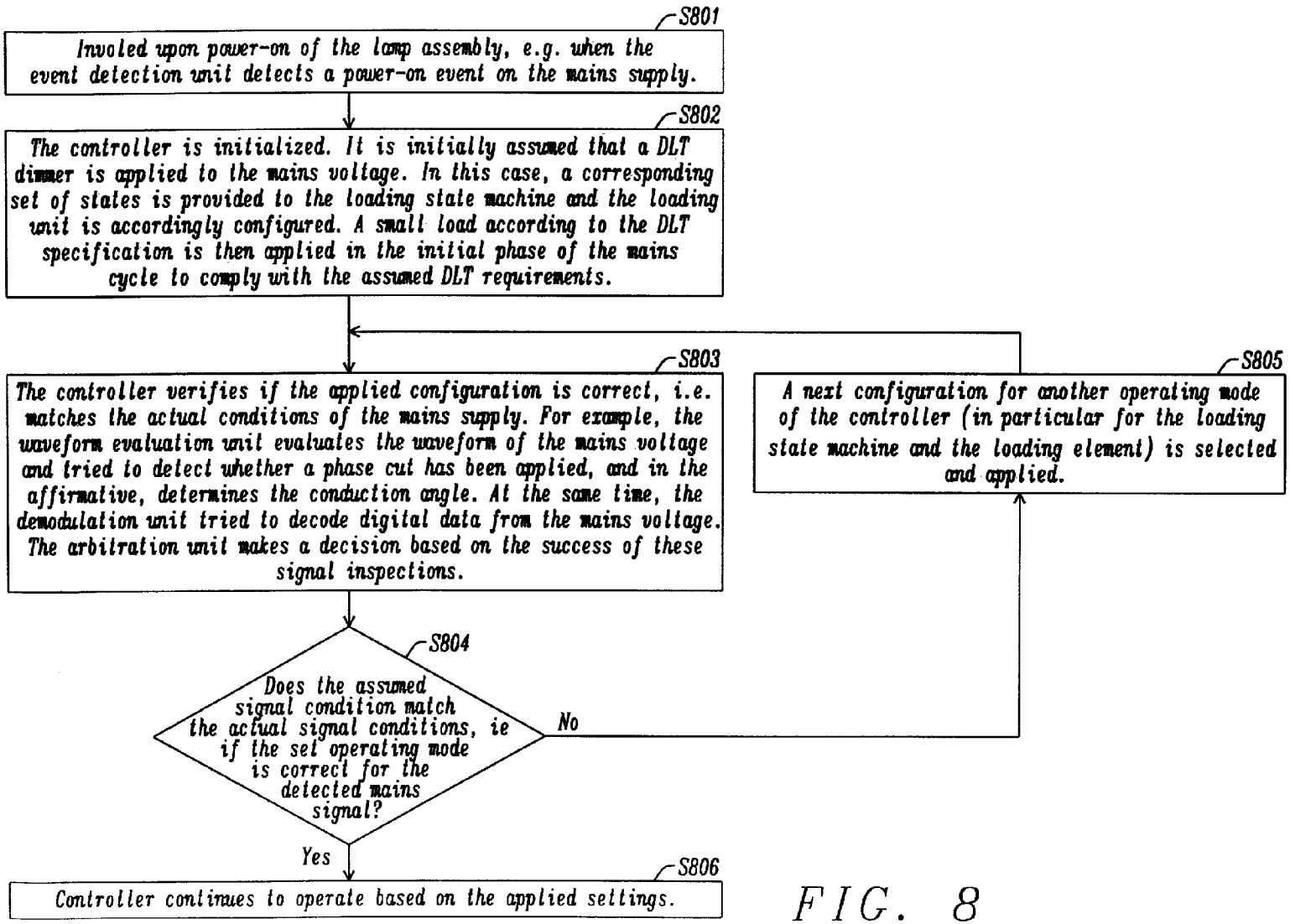
FIG. 8 shows an example flow diagram of a method for deciding the dim mode of a lamp assembly.

FIG. 8 illustrates an example flow diagram of a method to decide the operating mode of a controller. The method starts with step S801. Step S801 is for example invoked upon power-on of the lamp assembly, e.g. when the event detection unit detects a power-on event on the mains supply.

In step S802, the controller is initialized and initial (default) settings are loaded based on assumed signal conditions. For example, it is initially assumed that a DLT dimmer is applied to the mains voltage. In this case, a corresponding set of states is provided to the loading state machine and the loading unit is accordingly configured. A small load according to the DLT specification is then applied in the initial phase of the mains cycle to comply with the assumed DLT requirements. In this case, the system starts up with the assumption of a DLT dimmer employed in the mains supply. This has the advantage that the DLT requirements (which assume a stable system within 2 waveform cycles) are initially satisfied and a DLT compliant loading configuration is immediately applied. If it turns out that no such DLT scenario is present, the loading configuration can be switched after a few cycles. For scenarios where a phase cut dimmer is applied or even no dimmer is applied, this does not cause any problems. However, the present disclosure is not limited to this default value and another default configuration may be used, e.g. assuming no dimmer, or a leading edge phase cut dimmer.

The controller then applies the selected configuration and operates the lamp assembly accordingly (S803). At the same time, the controller verifies if the applied configuration is correct, i.e. matches the actual conditions of the mains supply. For example, the waveform evaluation unit evaluates the waveform of the mains voltage and tries to detect whether a phase cut has been applied, and in the affirmative, determines the conduction angle. At the same time, the demodulation unit tries to decode digital data from the mains voltage. The arbitration unit makes a decision based on the success of these signal inspections. Detailed steps of this evaluation may follow FIG. 9.

In step S804, it is determined whether the assumed signal condition matches the actual signal conditions, i.e. if the set operating mode is correct for the detected mains signal. If the operating mode set in the controller (e.g. the assumed dimmer that was applied to the mains voltage) matches measurement results from the waveform shape evaluation and/or the digital data decoding, the assumption is confirmed and the method proceeds to step S806 where the controller continues to operate based on the applied settings.

If it is determined that the assumption about the applied dimmer was incorrect, the method proceeds to step S805 where a next configuration for another operating mode of the controller (in particular for the loading state machine and the loading element) is selected and applied. The method then continues with step S803. The order in which the operating modes are tested and the corresponding configurations applied may be pre-defined and stored in a table in memory of the controller. A preferred order of dim modes is "DLT Mode", "Leading Edge Mode", "Trailing Edge Mode", and "Full Mains Mode".

Figure 9:
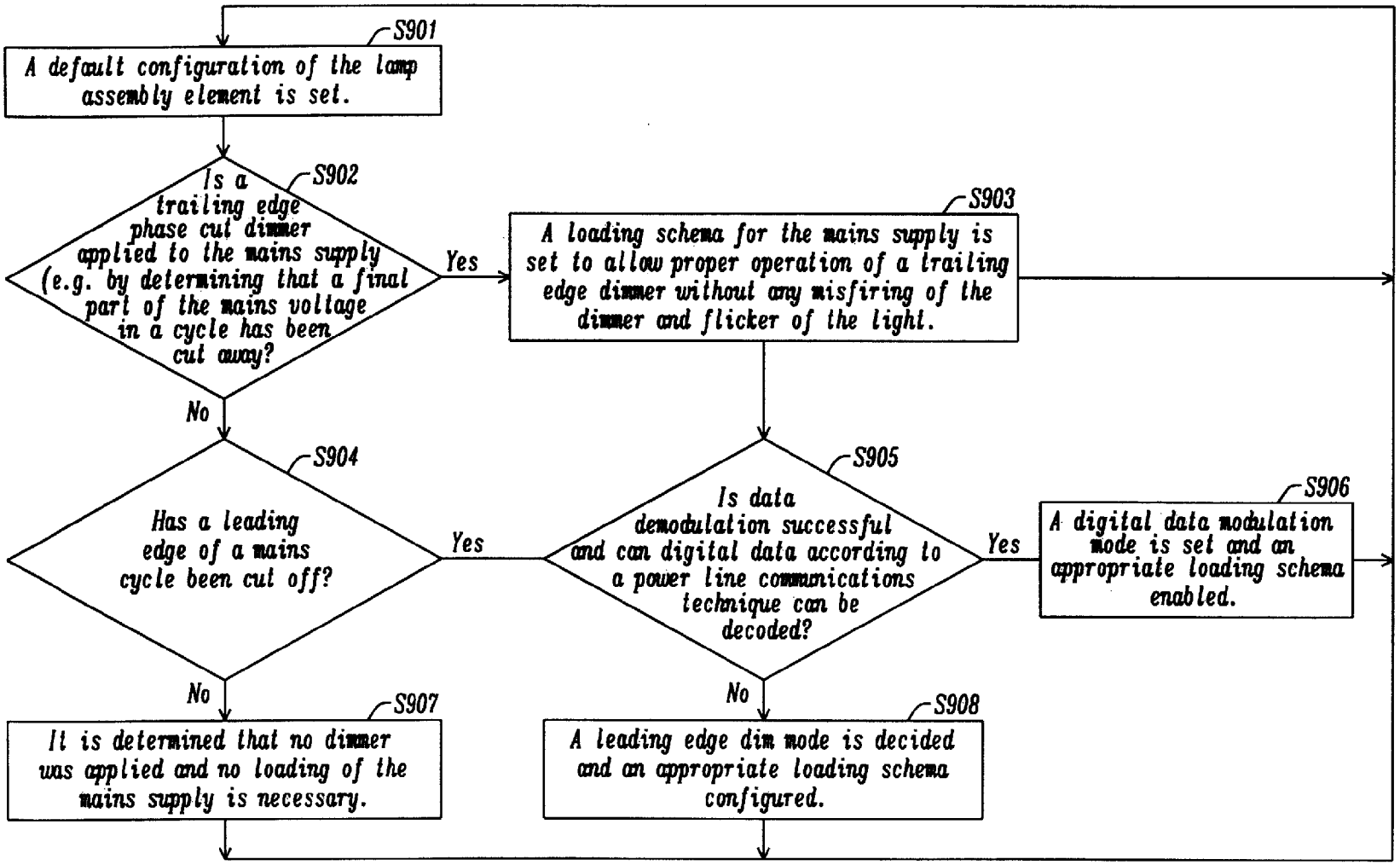
FIG. 9 shows another, example flow diagram of a method for deciding the dim mode of a lamp assembly.

FIG. 9 illustrates a possible decision flow for deciding the dim mode of the lamp assembly according to the measurements of the mains input voltage.

In step S901, a default configuration of the lamp assembly loading element is set. The default configuration may comply with the DLT requirements and include a small load in the initial portion of the mains cycle so that a dimmer control unit applied to the mains supply can function properly.

In step S902, it is determined if a trailing edge phase cut dimmer was applied to the mains supply, e.g. by determining that a final part of the mains voltage in a cycle has been cut away.

It has been determined that a trailing edge phase cut dimmer has been applied, a corresponding loading schema for the mains supply is set in step S903. This allows proper operation of a trailing edge dimmer without any misfiring of the dimmer and flicker of the light.

In step S904, it is determined if a leading edge of a mains cycle has been cut off. If no leading edge has been cut off (and no trailing edge has been cut of as determined in step S902), it is determined that no dimmer was applied and no loading of the mains supply is necessary.

On the other hand, if a leading edge of the mains half-cycle has been cut off, it is still possible that a leading edge phase cut dimmer or a DLT dimmer has been applied. Thus, in order to discriminate further, it is tested in step S905 if a data demodulation was successful and digital data according to a power line communications technique can be decoded. In the positive, a digital data modulation mode is set and an appropriate loading schema enabled in step S906.

If no digital data can be decoded from the mains voltage, a leading edge dim mode is decided and an appropriate loading schema configured in step S908.

The disclosed decision schema allows for a reliable detection of applied dimming technology by a lamp assembly. The lamp assembly can then operate in an appropriate dim or operating mode and enable a corresponding loading schema for the mains supply. The loading schema may include a sate machine to allow complex and time dependent loading. Depending on the selected dim or operating mode, the lamp assembly can determine the correct dimming (or other) information from the mains voltage and drive the light source accordingly. Optionally, received dimming such as illumination rate information may be translated to drive parameters (e.g. LED drive current) for the used light source, e.g. by applying a lookup function or characteristic curve. This allows a universal controller for the lamp assembly which adapts to the applied use scenario.

It should be noted that the principles of the present invention may also extended to linear controlled LEDs, e.g. systems which adjust the LED voltage to the mains voltage. The whole processing may be implemented in a microprocessor or a chip. All processing steps are configured using memory data, typically OTP data.

Moreover, it should be noted that the description and drawings merely illustrate the principles of the proposed methods and systems. Those skilled in the art will be able to implement various arrangements that, although not explicitly described or shown herein, embody the principles of the invention and are included within its scope. Furthermore, all examples and embodiments outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

Finally, it should be noted that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

The functions of the various elements shown in the figures may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, the explicit use of the term "processor" or "computer" should not be construed to refer exclusively to hardware capable of executing software, and may implicitly include, without limitation, digital signal processor (DSP) hardware, network processor, application specific integrated circuit (ASIC), field programmable gate array (FPGA), read-only memory (ROM) for storing software, random-access memory (RAM), and non-volatile storage. Other hardware, conventional and/or custom, may also be included.

What is claimed is:

1. A method for controlling a lamp assembly, comprising the steps of:

detecting a mains voltage supplied to the lamp assembly;

evaluating the waveform of the mains voltage and determining a light control signal based on the mains voltage waveform;

applying a demodulation process to the mains voltage to demodulate a digital data signal;

deciding a control operation mode based on the result of applying a demodulation process to the mains voltage; and generating a drive signal to drive a light source of the lamp assembly based on the determined light control signal or the demodulated data signal depending on the decided control operation mode, the method further comprising detecting whether a phase cut was applied to the mains voltage waveform and deciding the control operation mode based on whether a phase cut is detected or a digital data signal can be demodulated.

2. The method of claim 1, further comprising applying a configurable load to the mains voltage and controlling the configurable load based on the mains phase angle.

3. The method of claim 2, further comprising detecting events based on the mains voltage and maintaining a state machine based on the detected states, wherein the state machine comprises a plurality of load states and state transitions that are triggered based on detected events, and wherein a load state defines the configurable load.

4. The method of claim 3, wherein detecting mains voltage events comprises detecting when the mains voltage or a voltage derived therefrom crosses one or more predetermined voltage thresholds.

5. The method of claim 1, further comprising comparing the mains voltage or a voltage derived therefrom at predetermined times of the mains voltage cycle with predetermined voltage thresholds in order to determine the light control signal.

6. The method of claim 1, further comprising determining the root-mean-square (RMS) of a mains voltage half-wave in order to determine the light control signal.

7. The method of claim 1, wherein the step of applying a demodulation process comprises decoding a digital data signal that was modulated on the mains voltage, in particular by a power line communication technique.

8. The method claim 7, wherein the decoding includes amplitude demodulation of a baseband signal on the mains voltage.

9. The method of claim 1, wherein a phase cut dim mode is decided when a phase cut of the mains voltage is detected but no digital data signal can be demodulated, and a digital data modulation dim mode is decided when a leading edge phase cut of the mains voltage is detected and a data signal can be demodulated.

10. The method of claim 9, wherein if a digital data modulation dim mode is determined, a predetermined load is applied to the mains voltage during an initial portion of a mains half-wave.

11. A controller for a lamp assembly, comprising:

a mains sensing unit arranged to sense a mains voltage supplied to the lamp assembly;

a waveform evaluation unit coupled with the mains sensing unit and arranged to generate a light control signal based on the mains voltage waveform;

a demodulation unit coupled with the mains sensing unit and arranged to demodulate a digital data signal modulated onto the mains voltage;

a control unit arranged to generate a drive signal to drive a light source of the lamp assembly based on the determined light control signal or the demodulated digital data signal;

a load controller coupled with the mains sensing unit and a loading unit to apply a configurable load to the mains voltage, the load controller arranged to control the configurable load based on the mains phase angle, and an arbitration unit coupled at least with the demodulation unit and arranged to decide an operation mode of the controller, the control unit coupled with the arbitration unit and arranged to generate the drive signal depending on the decided operation mode.

12. The controller of claim 11, wherein the load controller controls the configurable load depending on the decided operation mode.

13. The controller of claim 11, wherein the load controller controls the configurable load so that no input current or a predetermined small input current is drawn from the mains voltage during a data period of the mains cycle if a digital data modulation dim mode is decided by the arbitration unit.

14. The controller of any of claims 11, wherein the control unit generates the drive signal to control a switched mode power converter that drives the light source, wherein, when a data modulation dim mode is decided by the arbitration unit, the control units generates the drive signal such that substantially no power is transferred by the switched mode power converter during an initial supply period and/or a data period of the mains cycle.

15. A lamp assembly comprising:

a controller for a lamp assembly, comprising:

a mains sensing unit arranged to sense a mains voltage supplied to the lamp assembly;

a waveform evaluation unit coupled with the mains sensing unit and arranged to generate a light control signal based on the mains voltage waveform;

a demodulation unit coupled with the mains sensing unit and arranged to demodulate a digital data signal modulated onto the mains voltage;

a control unit arranged to generate a drive signal to drive a light source of the lamp assembly based on the determined light control signal or the demodulated digital data signal; and a load controller coupled with the mains sensing unit and a loading unit to apply a configurable load to the mains voltage, the load controller arranged to control the configurable load based on the mains phase angle;

a loading unit;

a switched mode power converter; and a light source, wherein the loading unit and the switched mode power converter have a common transistor element that can be driven in a linear mode to operate the configurable load to the mains voltage and in an on/off mode to control the switched mode power converter.

16. The lamp assembly of claim 15 further comprising said controller with an arbitration unit coupled at least with the demodulation unit and arranged to decide an operation mode of the controller, the control unit coupled with the arbitration unit and arranged to generate the drive signal depending on the decided operation mode.

17. The lamp assembly of claim 16, wherein the load controller controls the configurable load depending on the decided operation mode.

18. The lamp assembly of claim 16, wherein the load controller controls the configurable load so that no input current or a predetermined small input current is drawn from the mains voltage during a data period of the mains cycle if a digital data modulation dim mode is decided by the arbitration unit.

19. The lamp assembly of claim 16, wherein the control unit generates the drive signal to control a switched mode power converter that drives the light source, wherein, when a data modulation dim mode is decided by the arbitration unit, the control units generates the drive signal such that substantially no power is transferred by the switched mode power converter during an initial supply period and/or a data period of the mains cycle.

* * * * *